US010093888B2

(12) United States Patent
Eiting et al.

(10) Patent No.: US 10,093,888 B2
(45) Date of Patent: Oct. 9, 2018

(54) SOLID DISHWASHING DETERGENT WITH IMPROVED PROTEASE PERFORMANCE

(71) Applicant: BASF SE, Ludwigshafen (DE)

(72) Inventors: Thomas Eiting, Duesseldorf (DE); Nina Mussmann, Willich (DE); Konstantin Benda, Duesseldorf (DE); Thorsten Bastigkeit, Wuppertal (DE); Timothy O'Connell, Duesseldorf (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/422,397

(22) PCT Filed: Aug. 13, 2013

(86) PCT No.: PCT/IB2013/056605

§ 371 (c)(1),
(2) Date: Jun. 24, 2015

(87) PCT Pub. No.: WO2014/030097

PCT Pub. Date: Feb. 27, 2014

(65) Prior Publication Data

US 2015/0291917 A1 Oct. 15, 2015

(30) Foreign Application Priority Data

Aug. 24, 2012 (DE) ..... 10 2012 215 107

(51) Int. Cl.
*C11D 3/386* (2006.01)
*C11D 3/395* (2006.01)

(52) U.S. Cl.
CPC ..... *C11D 3/38609* (2013.01); *C11D 3/3951* (2013.01); *C11D 3/3953* (2013.01)

(58) Field of Classification Search
None
See application file for complete search history.

(56) References Cited

U.S. PATENT DOCUMENTS

| | | | |
|---|---|---|---|
| 5,679,630 A | 10/1997 | Baeck et al. | |
| 6,586,221 B2 | 7/2003 | Graycar et al. | |
| 6,831,053 B1 | 12/2004 | Ghosh et al. | |
| 7,250,281 B2 | 7/2007 | Graycar et al. | |
| 2012/0006358 A1* | 1/2012 | Warkotsch | C11D 3/2096 134/18 |
| 2012/0238005 A1 | 9/2012 | Wieland et al. | |
| 2013/0005637 A1 | 1/2013 | Siegert et al. | |
| 2013/0071910 A1 | 3/2013 | Wieland et al. | |
| 2014/0018282 A1 | 1/2014 | Wieland et al. | |
| 2014/0227764 A1 | 8/2014 | Hellmuth et al. | |
| 2017/0037343 A1 | 2/2017 | Hellmuth et al. | |

FOREIGN PATENT DOCUMENTS

| | | |
|---|---|---|
| CN | 102498207 A | 6/2012 |
| EP | 1 921 147 A2 | 5/2008 |
| JP | 2015-502141 | 1/2015 |
| RU | 2136756 C1 | 9/1999 |
| WO | WO-95/23221 A1 | 8/1995 |
| WO | WO-2010/056671 A1 | 5/2010 |
| WO | WO-2011/032988 A1 | 3/2011 |
| WO | WO-2011/036264 A1 | 3/2011 |
| WO | WO-2011/110625 A1 | 9/2011 |
| WO | WO-2011/141358 A2 | 11/2011 |
| WO | WO-2012/080201 A2 | 6/2012 |
| WO | WO-2012/080202 A1 | 6/2012 |
| WO | WO-2013/060621 A1 | 5/2013 |
| WO | WO-2013/113689 A1 | 8/2013 |

OTHER PUBLICATIONS

Beard, J., 1972, James Beard's American Cookery, p. 728.*
Bystroff, C., et al., GenBank accession No. P29599.1, Apr. 1, 1993 [searched on Jun. 16, 2014, http://www.ncbi.nlm.nih.gov/protein/P29599.1].
International Search Report in international application No. PCT/IB2013/056605, dated Feb. 6, 2014.
Written Opinion in international application No. PCT/IB2013/056605, dated Jan. 24, 2014.
Notice of Reasons for Rejection, Japanese Patent Application No. 2015-527988, dated Apr. 25, 2017.

* cited by examiner

*Primary Examiner* — Anand U Desai
(74) *Attorney, Agent, or Firm* — Marshall, Gerstein & Borun LLP

(57) ABSTRACT

The aim is to improve detergency, in particular on custard stains, in an essentially solid dishwashing detergent. This is accomplished with an essentially solid dishwashing detergent which comprises a protease which comprises an amino acid sequence which is at least 80% identical to the amino acid sequence given in SEQ ID NO. 1 and which has the amino acid glutamic acid (E) or aspartic acid (D) at position 99 in the count according to SEQ ID NO. 1.

21 Claims, No Drawings

Specification includes a Sequence Listing.

SOLID DISHWASHING DETERGENT WITH IMPROVED PROTEASE PERFORMANCE

CROSS-REFERENCE TO RELATED APPLICATIONS

This is the U.S. national phase of International Application No. PCT/Ib2013/056605, filed Aug. 13, 2013, which claims benefit of German Application No, 102012215107.9, filed Aug. 24, 2012.

The invention is in the field of dishwashing detergents. The invention relates in particular to predosed, essentially solid dishwashing detergents which comprise proteases, and to methods in which such compositions are used. The invention further relates to uses of such compositions.

Dishwashing detergents are available to the consumer in a large number of supply forms. As well as traditional liquid handwashing detergents, with the spread of domestic dishwashers in particular machine dishwashing detergents have gained great importance. These machine dishwashing detergents are typically supplied to the consumer in solid form, for example as powders or as tablets. Increasingly, they are made available to the consumer in a predosed form, meaning that the consumer no longer has to do the dosing independently, but usually merely has to place a predosed unit of the composition for one wash cycle in the machine.

One of the main aims of the manufacturers of machine detergents is improving the detergency of these compositions. Certain stains, especially custard stains and, in this regard, to a particular degree burnt-on custard stains, however, constitute stubborn stains which are often not removed satisfactorily. Modern dishwashing detergents, in particular machine dishwashing detergents, often do not meet the set requirements with regard to removing such stains. There is therefore still a need for dishwashing detergents and, among these, in particular machine dishwashing detergents, which reliably remove such stains. This applies in particular to predosed, essentially solid formulation variants of such compositions.

The European patent specification EP 1921147 B1 discloses proteases which, as well as laundry detergents, can also be used for the machine cleaning of hard surfaces, for example dishes. These proteases are characterized in that they can have the amino acid glutamic acid (Glu, E) at position 99 alongside other amino acids. Corresponding proteases are disclosed in the laid-open specifications WO 2011/032988, WO 2011/141358, WO 2012/080201 and WO 2012/080202 as cleaning-active component of corresponding compositions, but only for liquid compositions, in particular laundry detergents. The use of corresponding proteases in predosed, essentially solid dishwashing detergents is not evident from the prior art.

The object of the present invention is to provide predosed, essentially solid dishwashing detergents with improved detergency on custard stains, in particular burnt-on custard stains.

The invention provides a predosed, essentially solid dishwashing detergent comprising a protease which comprises an amino acid sequence which is at least 80% identical to the amino acid sequence given in SEQ ID NO. 1 and which has the amino acid glutamic acid (E) or aspartic acid (D) at position 99 in the count according to SEQ ID NO. 1.

Surprisingly, it has been established that dishwashing detergents of this type which comprise those proteases which have very good detergency and consequently exhibit very good detergency on stubborn stains, in particular on custard stains and, in this regard, to a particular extent on burnt-on custard stains. Preferred embodiments of compositions according to the invention exhibit such advantageous detergencies even at low temperatures and/or in the event of short wash cycles. Within the context of the invention, a low temperature is preferably between 10° C. and 50° C., preferably between 15° C. and 45° C. and particularly preferably between 20° C. and 40° C. A short wash cycle lasts preferably at most 60 minutes, 45 minutes or merely at most 30 minutes.

The detergency describes the ability of a dishwashing detergent, in particular a machine dishwashing detergent, to partially or completely remove an existing stain. Within the context of the invention, both the dishwashing detergent which comprises the protease and/or the cleaning liquor formed by this composition, as well as the protease itself has a particular detergency. The detergency of the enzyme thus contributes to the detergency of the composition or of the cleaning liquor formed by the composition.

Cleaning liquor is understood as meaning the use solution comprising the dishwashing detergent which acts upon the hard surfaces and thereby comes into contact with the stains present on the hard surfaces. Usually, the cleaning liquor is formed when the cleaning process starts and the dishwashing detergent is diluted with water for example in a dishwasher or in another suitable container.

A predosed dishwashing detergent comprises every formulation form which is designed such that the consumer no longer has to undertake dosing before a wash cycle. The composition is therefore provided to the consumer preferably in a portioned form, especially such that he only has to provide one portion of the composition prior to a cleaning process. The predosed composition is therefore present in the form of prefabricated dosage units. A particularly preferred predosed variant is a tablet. A further particularly preferred predosed variant is for example a defined amount of powder which is provided in a packaging unit. For example, the amount of powder required for the wash cycle is enclosed by a water-soluble film which dissolves at the start of the washing process and then releases the dishwashing detergent. Formulation variants of this type are often referred to as pouches.

The dishwashing detergent is essentially solid. This means that although the dishwashing detergent can comprise liquid fractions, it is not predominantly liquid, but has a non-liquid appearance overall. Usually, the composition comprises less than 50% by weight of liquid fractions. Increasingly preferably, the composition comprises less than 60% by weight, less than 70% by weight, less than 80% by weight, less than 85% by weight, less than 90% by weight, less than 95% by weight and particularly preferably less than 99% by weight, of liquid fractions. Very particularly preferably, it comprises only solid fractions. In this regard, solid fractions comprise any solid formulation form, for example powders, granules, extrudates or tablets or other shaped bodies.

The protease present in a washing or cleaning composition according to the invention comprises an amino acid sequence which is at least 80% identical to the amino acid sequence given in SEQ ID NO. 1 and which has the amino acid glutamic acid (E) or aspartic acid (D) at position 99 in the count according to SEQ ID NO. 1. Increasingly preferably, the amino acid sequence is at least 81%, 82%, 83%, 84%, 85%, 86%, 87%, 88%, 89%, 90%, 91%, 92%, 93%, 94%, 95%, 96%, 97%, 98% and very particularly preferably 99% identical to the amino acid sequence given in SEQ ID NO. 1. SEQ ID NO. 1 is the sequence of the ripe (mature) alkaline protease from *Bacillus lentus* DSM 5483, which is disclosed in the International patent application WO 92/21760, and to the disclosure of which reference is hereby expressly made.

A protease that is very particularly preferred according to the invention has an amino acid sequence which, in positions 1-98 and 100 to 269, is in agreement with SEQ ID NO. 1 and which has the amino acid glutamic acid (E) at position 99 in the count according to SEQ ID NO. 1. A protease of this type is given in SEQ ID NO. 2.

A further protease that is very particularly preferred according to the invention has an amino acid sequence which, in positions 1-98 and 100 to 269, is in agreement with SEQ ID NO. 1 and which has the amino acid aspartic acid (D) at position 99 in the count according to SEQ ID NO. 1. A protease of this type is given in SEQ ID NO. 3.

The determination of the identity of nucleic acid or amino acid sequences takes place by means of a sequence comparison. Such a comparison takes place by assigning similar sequences in the nucleotide sequences or amino acid sequences to one another. This sequence comparison is made preferably on the basis of the BLAST algorithm that is customarily used and established in the prior art (cf. for example Altschul, S. F., Gish, W., Miller, W., Myers, E. W. & Lipman, D. J. (1990) "Basic local alignment search tool." J. Mol. Biol. 215:403-410, and Altschul, Stephan F., Thomas L. Madden, Alejandro A. Schaffer, Jinghui Zhang, Hheng Zhang, Webb Miller, and David J. Lipman (1997): "Gapped BLAST and PSI-BLAST: a new generation of protein database search programs"; Nucleic Acids Res., 25, pp. 3389-3402) and is accomplished in principle by assigning similar sequences of nucleotides or amino acids in the nucleic acid or amino acid sequences to one another. A tabular assignment of the relevant positions is referred to as alignment. A further algorithm available in the prior art is the FASTA algorithm. Sequence comparisons (alignments), in particular multiple sequence comparisons, are usually generated with computer programs. Use is often made for example of the Clustal series (cf. for example Chenna et al. (2003): Multiple sequence alignment with the Clustal series of programs. Nucleic Acid Research 31, 3497-3500), T-Coffee (cf. for example Notredame et al. (2000): T-Coffee: A novel method for multiple sequence alignments. J. Mol. Biol. 302, 205-217) or programs which are based on these programs or algorithms. For the purposes of the present invention, sequence comparisons and algorithms are created preferably with the computer program Vector NTI® Suite 10.3 (Invitrogen Corporation, 1600 Faraday Avenue, Carlsbad, Calif., USA) with the pregiven standard (default) parameters.

Such a comparison reveals the similarity of the compared sequences to one another. It is usually given in percent identity, i.e. the fraction of identical nucleotides or amino acid radicals at the same positions or at positions corresponding to one another in an alignment. The more widely interpreted term of homology includes in the consideration conserved amino acid replacements for amino acid sequences, i.e. amino acids with similar properties since these mostly perform similar activities or functions within the protein. Consequently, the similarity of the compared sequences can also be given as percent homology or percent similarity. Identity and/or homology data can be affected by whole polypeptides or genes or only via individual regions. Homolog and identical regions of different nucleic acid or amino acid sequences are therefore defined by agreements in the sequences. They often have identical or similar functions. They may be small or only comprise a few nucleotides or amino acids. Often, such small regions perform essential functions for the overall activity of the protein. It may therefore be useful to relate sequence agreements only to individual, possibly small regions. Unless stated otherwise, however, identity and homology data refer in the present application to the entire length of the nucleic acid or amino acid sequence stated in each case.

In a further embodiment of this subject matter of the invention, the washing or cleaning composition is characterized in that the protease comprises an amino acid sequence which is identical to the amino acid sequence given in SEQ ID NO. 1, as stated above and which is obtained or is obtainable from a protease according to SEQ ID NO. 1 by means of single or multiple conservative amino acid substitution, where the protease at position 99 still has one of the amino acids intended for this position, as described above. The term "conservative amino acid substitution" means the exchange (substitution) of an amino acid radical for a different amino acid radical, where this exchange does not lead to a change in the polarity or charge at the position of the exchanged amino acid, e.g. the exchange of a nonpolar amino acid radical for a different nonpolar amino acid radical. Within the context of the invention, conservative amino acid substitutions comprise for example: G=A=S, I=V=L=M, D=E, N=Q, K=R, Y=F, S=T, G=A=I=V=L=M=Y=F=W=P=S=T.

A dishwashing detergent according to the invention comprises the protease increasingly preferably in an amount of $1\times10^{-8}$-10% by weight, of 0.00001-2% by weight, of 0.001-1% by weight, of 0.007 to 0.8% by weight, of 0.025 to 0.5% by weight and particularly preferably of 0.04 to 0.38% by weight, based on the total protein content of the protease. The protein concentration can be determined with the help of known methods, for example the BCA method (bicinchoninic acid; 2,2'-biquinolyl-4,4'-dicarboxylic acid) or the biuret process (A. G. Gornall, C. S. Bardawill and M. M. David, J. Biol. Chem., 177 (1948), pp. 751-766).

The protease can also be absorbed to carriers and/or embedded in coating substances in order to protect it from premature inactivation. In the cleaning liquor, i.e. under application conditions, the enzyme is then released and can develop its catalytic effect.

A further embodiment of dishwashing detergents according to the invention further comprises a bleach activator. The substances are preferably bleach-boosting transition metal salts or transition metal complexes such as, for example, Mn-, Fe-, Co-, Ru- or Mo-salene complexes or -carbonyl complexes. Mn, Fe, Co, Ru, Mo, Ti, V and Cu complexes with N-containing tripod ligands and also Co-, Fe-, Cu- and Ru-ammine complexes can also be used as bleach catalyst.

Particular preference is given to using complexes of manganese in oxidation state II, III, IV or IV which preferably comprise one or more macrocyclic ligand(s) with the donor functions N, NR, PR, O and/or S. Preference is given to using ligands which have nitrogen donor functions. In this connection, it is particularly preferred to use bleach catalyst(s) in the compositions according to the invention which comprise, as macromolecular ligands 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (Me/Me-TACN) and/or 2-methyl-1,4,7-triazacyclononane (Me/TACN). Suitable manganese complexes are for example $[Mn^{III}{}_2(\mu\text{-}O)_1(\mu\text{-}OAc)_2(TACN)_2](ClO_4)_2$, $[Mn^{III}Mn^{IV}(\mu\text{-}O)_2(\mu\text{-}OAc)_1(TACN)_2](BPh_4)_2$, $[Mn^{IV}{}_4(\mu\text{-}O)_6(TACN)_4](ClO_4)_4$, $[Mn^{III}{}_2(\mu\text{-}O)_1(\mu\text{-}OAc)_2(Me\text{-}TACN)_2](ClO_4)_2$, $[Mn^{III}Mn^{IV}(\mu\text{-}O)_1(\mu\text{-}OAc)_2$ $(Me\text{-}TACN)_2](ClO_4)_3$, $[Mn^{IV}{}_2(\mu\text{-}O)_3(Me\text{-}TACN)_2](PF_6)_2$ and $[Mn^{IV}{}_2(\mu\text{-}O)_3(Me/Me\text{-}TACN)_2](PF_6)_2(OAc{=}OC(O)CH_3)$.

Dishwashing detergents, in particular machine dishwashing detergents, wherein they comprise a bleach catalyst selected from the group of bleach-boosting transition metal salts and transition metal complexes, preferably from the group of complexes of manganese with 1,4,7-trimethyl-1,4,7-triazacyclononane (Me-TACN) or 1,2,4,7-tetramethyl-1,4,7-triazacyclononane (Me/Me-TACN), are preferred according to the invention since in particular the cleaning result can be significantly improved by means of the aforementioned bleach catalysts.

The aforementioned bleach-boosting transition metal complexes, in particular with the central atoms Mn and Co, are used preferably in an amount up to 5% by weight, in particular from 0.0025% by weight to 1% by weight and particularly preferably from 0.01% by weight to 0.30% by weight, in each case based on the total weight of the bleach-catalyst-containing composition. In specific cases, however, more bleach catalyst may also be used.

In such a further embodiment, a dishwashing detergent according to the invention further comprises a hydrogen peroxide source. These are compounds which produce or are able to produce $H_2O_2$ in water. The hydrogen peroxide source is preferably a bleach, with oxygen bleaches being preferred according to the invention.

Among the compounds producing $H_2O_2$ in water that serve as bleaches, sodium percarbonate, sodium perborate tetrahydrate and sodium perborate monohydrate are of particular importance. Further bleaches that can be used are, for example, peroxypyrophosphates, citrate perhydrates, and $H_2O_2$-producing peracidic salts or peracids, such as perbenzoates, peroxophthalates, diperazelaic acid, phthaloiminoperacid or diperdodecanedioic acid.

Furthermore, it is also possible to use bleaches from the group of organic bleaches. Typical organic bleaches are the diacyl peroxides, such as e.g. dibenzoyl peroxide. Further typical organic bleaches are the peroxy acids, examples specifically being the alkylperoxy acids and the arylperoxy acids.

Preferably, the hydrogen peroxide source is present in the dishwashing detergent according to the invention in an amount of 2-30% by weight and increasingly preferably of 4-25% by weight, of 5-20% by weight and particularly preferably of 6-15% by weight, in each case based on the total weight of the dishwashing detergent. Preferred dishwashing detergents are also ones wherein the dishwashing detergent comprises, in each case based on the total weight of the dishwashing detergent, 2 to 20% by weight, preferably 3 to 18% by weight and in particular 4 to 15% by weight, of sodium percarbonate.

Particularly preferred embodiments of dishwashing detergents according to the invention are consequently ones wherein the bleach catalyst is selected from the group of the bleach-boosting transition metal salts and transition metal complexes, preferably from the group of the complexes of manganese with 1,4,7-trimethyl-1,4,7-triazacyclononane (Me-TACN) or 1,2,4,7-tetramethyl-1,4,7-triazacyclononane (Me/Me-TACN), and the hydrogen peroxide source is sodium percarbonate, sodium perborate tetrahydrate or sodium perborate monohydrate or a combination thereof. Very particularly preferably, the bleach catalyst is a complex of manganese with 1,4,7-trimethyl-1,4,7-triazacyclononane (Me-TACN), in particular $[Mn^{IV}{}_2(\mu\text{-}O)_3(Me\text{-}TACN)_2](PF_6)_2$, or 1,2,4,7-tetramethyl-1,4,7-triazacyclononane (Me/Me-TACN) or a mixture thereof, and the hydrogen peroxide source is sodium percarbonate. In the specified combinations, the bleach catalyst and the hydrogen peroxide source are preferably present in the amounts specified above in each case.

Dishwashing detergents according to the invention, in particular machine dishwashing detergents, can also comprise bleach activators, for example in order to achieve an improved bleaching effect when cleaning at temperatures of 60° C. and below. Bleach activators which can be used are compounds which, under perhydrolysis conditions, produce aliphatic peroxocarboxylic acids having preferably 1 to 10 carbon atoms, in particular 2 to 4 carbon atoms, and/or optionally substituted perbenzoic acid. Substances which carry O- and/or N-acyl groups of the stated number of carbon atoms and/or optionally substituted benzoyl groups are suitable. Preference is given to polyacylated alkylene diamines, with tetraacetylethylenediamine (TAED) having proven to be particularly suitable.

These bleach activators, in particular TAED, are used preferably in amounts of 0.1-10% by weight, in particular 0.1-8% by weight, particularly 2-8% by weight and especially preferably 2-6% by weight, in each case based on the total weight of the bleach-activator-containing composition.

In a preferred embodiment of the invention, a dishwashing detergent according to the invention is a machine dishwashing detergent. According to this application, machine dishwashing detergent is the term used to refer to compositions which can be used for cleaning soiled dishes in a machine dishwashing process. Consequently, the machine dishwashing detergents according to the invention differ for example from machine rinse aids which are always used in combination with machine dishwashing detergents and do not develop a cleaning action of their own.

Machine-washed dishes are often subject to higher requirements than manually washed dishes. For example, after machine cleaning, the dishes should not only be free from food remains, but for example also have no whitish marks based on water hardness or other mineral salts which originate from dried-on water drops for lack of wetting agents. Modern machine dishwashing detergents meet these requirements through the integration of cleaning and/or care and/or water-softening and/or rinse-aid active ingredients and are known to the consumer for example as "2in1"- or "3in1"-dishwashing detergents. As a constituent that is essential for cleaning and rinse aid success, the machine dishwashing detergents comprise builders. These builders firstly increase the alkalinity of the cleaning liquor, with fats and oils being emulsified and saponified with increasing alkalinity, and secondly reduce the water hardness of the cleaning liquor as a result of complexation of the calcium ions present in the aqueous liquor.

In a further embodiment of the invention, the dishwashing detergent is present as a pourable powder or as a shaped body, in particular as a tablet.

A pourable powder preferably has a bulk density of from 300 g/l to 1200 g/l, in particular 500 g/l to 900 g/l or 600 g/l to 850 g/l.

The dishwashing detergents according to the invention, in particular the machine dishwashing detergents, are preferably in the form of a shaped body, in particular a compact, primarily a tablet. The shaped body may, however, for example also be granules, which are present in a bag or a cast mold.

Compositions according to the invention can be formulated as single-phase or multiphase products. Preference is given in particular to machine dishwashing detergents with one, two, three or four phases. Machine dishwashing detergents which are in the form of a prefabricated dosing unit with two or more phases are particularly preferred. Particular preference is given in particular to two- or multiphase tablets, for example two-layered tablets, in particular two-layered tablets with an indentation and a shaped body located in the indentation.

Machine dishwashing detergents according to the invention are preferably preformulated as dosing units. These dosing units preferably comprise the amount of washing- or cleaning-active substances required for one cleaning cycle. Preferred dosing units have a weight between 12 and 30 g, preferably between 14 and 26 g and in particular between 15 and 22 g.

The volume of the aforementioned dosage units and their three-dimensional shape are particularly preferably chosen such that a dosability of the preformulated units is ensured via the dosing chamber of a dishwasher. The volume of the dosage unit is therefore preferably between 10 and 35 ml, preferably between 12 and 30 ml and in particular between 15 and 25 ml.

The machine dishwashing detergents according to the invention, in particular the pre-prepared dosage units, have a water-soluble coating in one preferred embodiment.

The production of solid compositions according to the invention presents no difficulties and can take place in a known manner, for example by spray-drying or granulation, where enzymes and possible other thermally sensitive ingredients such as, for example, bleaches, can optionally be added separately at a later time. To produce compositions according to the invention with an increased bulk density, in particular in the range from 650 g/l to 950 g/l, a process having an extrusion step is preferred.

The production of shaped bodies according to the invention, in particular of the cleaning composition tablets, takes place preferably in a manner known to the person skilled in the art by compressing particulate starting substances. To produce the tablets, the premix is compacted in a so-called die between two punches to give a solid compact. This operation, which is referred to below as tableting for short, is divided into four sections: dosage, compaction (elastic deformation), plastic deformation and expulsion. The tableting preferably takes place on so-called rotary presses.

In the case of tableting with rotary presses, it has proven to be advantageous to carry out the tableting with the lowest possible weight variations of the tablet. In this way, it is also possible to reduce the hardness variations of the tablet. Weight fluctuations can be minimized in the following way:

- use of plastic inlays having low thickness tolerances
- low rotational speed of the rotor
- large filling shoe
- matching of the rotational speed of the filling shoe vane to the rotational speed of the rotor
- filling shoe with constant powder height
- decoupling of filling shoe and powder reservoir.

The ingredients intended for the tableting can be introduced into the die in the form of a common particulate premix at the same time or in the form of individual, separate powders or granules at different times or at the same time, preference being given to the dosing of a preprepared particulate premix.

Surprisingly, it has been found that granules used to produce the shaped bodies can be compressed particularly readily. Thus, preferably using a compressive force of 40 to 65 kN, particularly preferably from 48 to 60 kN, it is possible to obtain compacts with a hardness in the range from 150 to 250 N, in particular in the range from 200 to 230 N, which, moreover, have particularly good pouring properties. The granules can thus preferably be compressed using a relatively low compressive force to give compacts with a relatively high hardness which, moreover, preferably have very good pouring properties. Accordingly, it is conversely advantageous that preferably a lower compressive force has to be applied to produce compacts of relatively low hardness than for producing customary compacts.

In a further preferred embodiment, compositions according to the invention, in particular shaped bodies, comprise polyvinylpyrrolidone particles. These particles facilitate, inter alia, the disintegration of the shaped bodies and in this respect serve as disintegration auxiliaries or tablet disintegrants. According to the invention, it has proven to be particularly advantageous to use polyvinylpyrrolidone particles with an average particle diameter of 100 to 150 μm, in particular with an average particle diameter of 110 to 130 μm.

Within the context of the present invention, the term "average particle diameter" or "average diameter" is to be understood as meaning the volume-average $D_{50}$ particle diameter which can be determined by customary methods. The volume-average $D_{50}$ particle diameter is the point in the particle size distribution at which 50% by volume of the particles have a smaller diameter and 50% by volume of the particles have a larger diameter. The average particle diameters can be determined in particular with the help of dynamic light scattering, which is usually carried out on dilute suspensions, which comprise e.g. 0.01 to 1% by weight of particles.

Particularly preferably, the PVP particles not only have an average particle diameter of 100 to 150 μm, in particular from 110 to 130 μm, but moreover the particle size of the particles used preferably lies entirely within the stated intervals. This is ensured by using particle size fractions with the stated particle sizes which have been obtained by means of a screening method.

The PVP particles are present in compositions according to the invention, in particular shaped bodies, preferably in an amount of from 0.1 to 5% by weight, in particular in an amount of from 0.2 to 3% by weight, especially in an amount of from 0.3 to 1.8% by weight.

The effect of disintegrants generally consists in increasing their volume upon the ingress of water, where, on the one hand, the intrinsic volume is increased (swelling), but on the other hand the release of gases can also generate a pressure which causes the tablet to break up into smaller particles. In addition to or alternatively to the PVP particles, further disintegrants may also be present in compositions according to the invention, in particular shaped bodies, for example carbonate/citric acid systems or carbonate in combination with other organic acids, synthetic polymers or natural polymers or modified natural substances such as cellulose and starch and their derivatives, as well as alginates or casein derivatives. Furthermore, gas-evolving effervescent systems can also be used as further disintegrants. Preferred effervescent systems consist of at least two constituents which react together with the formation of gas, for example of alkali metal carbonate and/or hydrogencarbonate and also an acidifying agent which is suitable for releasing carbon-dioxide from the alkali metal salts in aqueous solution. An acidifying agent which releases carbon dioxide from the alkali metal salts in aqueous solution is for example citric acid.

The further disintegration auxiliaries, if used, are used preferably in amounts of from 0.1 to 10% by weight, preferably 0.2 to 5% by weight and in particular 0.5 to 2% by weight, in each case based on the total weight of the disintegration-auxiliary-containing composition.

In further embodiments, presentation forms of compositions according to the invention can also consist of a plurality of phases, and also be present in compacted or non-compacted form. A composition according to the invention can also be packaged in a container, preferably an air-tight container, from which it is released shortly before use or during the cleaning process.

In a further embodiment of the invention, a dishwashing detergent according to the invention further comprises at least one further ingredient which is selected from the group consisting of builder, surfactant, anionic polymer, and also combinations thereof. In a further embodiment of the invention, a dishwashing detergent according to the invention is phosphate-free. Phosphate-free dishwashing detergents according to the invention are in particular advantageous from environmental aspects.

Preferably, the ingredients of the compositions are matched to one another. Preference is given to synergies as regards the detergency and/or the clear rinse performance and/or the inhibition of filming. Particular preference is given to synergies which are present in a temperature range between 10° C. and 60° C., in particular in a temperature range from 10° C. to 70° C., from 10° C. to 60° C., from 10° C. to 50° C., from 15° C. to 50° C., from 20° C. to 45° C. and from 20° C. to 40° C.

The group of preferred builders includes in particular the citrates and the carbonates and the organic cobuilders. The name "citrate" comprises here likewise citric acid as well as its salts, in particular its alkali metal salts. Particularly preferred dishwashing detergents according to the invention, in particular machine dishwashing detergents, comprise citric acid and citrate, preferably sodium citrate, in amounts of from 5 to 60% by weight, preferably 10 to 50% by weight and in particular 15 to 40% by weight.

Particular preference is given to the use of carbonate(s) and/or hydrogencarbonate(s), preferably alkali metal carbonate(s), particularly preferably sodium carbonate, in amounts of from 5 to 50% by weight, preferably from 10 to 40% by weight and in particular from 15 to 30% by weight, in each case based on the weight of the dishwashing detergent.

Organic cobuilders to be mentioned are in particular polycarboxylates/polycarboxylic acids and phosphonates. These substance classes are described below.

Organic builder substances that can be used are, for example, the polycarboxylic acids that can be used in the form of the free acid and/or their sodium salts, where polycarboxylic acids are understood as meaning those carboxylic acids which carry more than one acid function. By way of example, these are adipic acid, succinic acid, glutaric acid, malic acid, tartaric acid, maleic acid, fumaric acid, sugar acids, aminocarboxylic acids, nitrilotriacetic acid (NTA), and mixtures of these. Besides their builder effect, the free acids typically also have the property of an acidification component and thus also serve for establishing a lower and more mild pH of compositions according to the invention. In particular, in this connection, succinic acid, glutaric acid, adipic acid, gluconic acid and any desired mixtures of these are to be mentioned.

Besides 1-hydroxyethane-1,1-diphosphonic acid, the complex-forming phosphonates comprise a series of different compounds such as, for example, diethylenetriaminepenta(methylenephosphonic acid) (DTPMP). In this application, preference is given in particular to hydroxyalkane- or aminoalkanephosphonates. Among the hydroxyalkanephosphonates, 1-hydroxyethane-1,1-diphosphonate (HEDP) is of particular importance as a cobuilder. It is preferably used as sodium salt, where the disodium salt gives a neutral reaction and the tetrasodium salt gives an alkaline reaction (pH 9). Suitable aminoalkanephosphonates are preferably ethylenediaminetetra-methylenephosphonate (EDTMP), diethylenetriaminepentamethylenephosphonate (DTPMP), and higher homologs thereof. They are preferably used in the form of the neutrally reacting sodium salts, e.g. as hexasodium salt of EDTMP or as hepta- and octa-sodium salt of DTPMP. The builder from the class of phosphonates preferably used here is HEDP. Moreover, the aminoalkanephosphonates have a pronounced heavy metal binding capacity. Accordingly, particularly if the compositions also comprise bleaches, it may be preferred to use aminoalkanephosphonates, in particular DTPMP, or mixtures of said phosphonates.

A dishwashing detergent preferred within the scope of this application, in particular machine dishwashing detergent, comprises one or more phosphonate(s) from the group a) aminotrimethylenephosphonic acid (ATMP) and/or salts thereof;
b) ethylenediaminetetra(methylenephosphonic acid) (EDTMP) and/or salts thereof;
c) diethylenetriaminepenta(methylenephosphonic acid) (DTPMP) and/or salts thereof;
d) 1-hydroxyethane-1,1-diphosphonic acid (HEDP) and/or salts thereof;
e) 2-phosphonobutane-1,2,4-tricarboxylic acid (PBTC) and/or salts thereof;
f) hexamethylenediaminetetra(methylenephosphonic acid) (HDTMP) and/or salts thereof;
g) nitrilotri(methylenephosphonic acid) (NTMP) and/or salts thereof.

Particular preference is given to machine dishwashing detergents which comprise, as phosphonates, 1-hydroxyethane-1,1-diphosphonic acid (HEDP) or diethylenetriaminepenta(methylenephosphonic acid) (DTPMP).

Furthermore, the dishwashing detergents according to the invention, in particular machine dishwashing detergents, can comprise two or more different phosphonates.

The weight fraction of the phosphonates of the total weight of dishwashing detergents according to the invention, in particular machine dishwashing detergents, is preferably 1 to 8% by weight, preferably 1.2 to 6% by weight and in particular 1.5 to 4% by weight.

Dishwashing detergents according to the invention, in particular machine dishwashing detergents, can comprise one or more surfactants, with in particular anionic surfactants, nonionic surfactants and mixtures thereof being of suitability.

Among the anionic surfactants, preference is given to those which have at least one sulfate or sulfonate group. The anionic surfactant with at least one sulfate or sulfonate group is preferably selected from fatty alcohol sulfates, alkanesulfonates and alkylbenzene sulfonates. Preference here is given to $C_{12}$-$C_{18}$-fatty alcohol sulfates (FAS), e.g. Sulfopon K 35 (Cognis, Germany), secondary $C_{13}$-$C_{17}$-alkanesulfonates (SAS), e.g. Hostapur SAS 93 (Clariant, Germany), as well as linear $C_8$-$C_{18}$-alkylbenzenesulfonates, in particular dodecylbenzenesulfonate (LAS).

According to the invention, the terms "sulfate" and "sulfonate" comprise not only the anionic compounds in question that are present in the form of salt, but also the free acids, i.e. the corresponding alkylsulfuric acids or alkylsulfonic acids.

Preferably, the anionic surfactant with at least one sulfate or sulfonate group in dishwashing detergents according to the invention is present in an amount of from 0.1 to 20% by weight, particularly preferably 0.5 to 15% by weight, in particular 2.5 to 10% by weight.

Nonionic surfactants which can be used are all nonionic surfactants known to the person skilled in the art. Suitable nonionic surfactants are, for example, alkyl glycosides of the general formula $RO(G)_x$, in which R is a primary straight-chain or methyl-branched, in particular 2-methyl-branched aliphatic radical having 8 to 22, preferably 12 to 18 carbon atoms, and G is the symbol which stands for a glycose unit having 5 or 6 carbon atoms, preferably glucose. The degree of oligomerization x, which indicates the distribution of monoglycosides and oligoglycosides, is any desired number between 1 and 10; preferably, x is 1.2 to 1.4.

A further class of preferably used nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type may also be suitable. The amount of these nonionic surfactants is preferably not more than that of the ethoxylated fatty alcohols, in particular not more than half thereof.

Further suitable surfactants are polyhydroxy fatty acid amides of the formula,

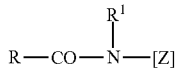

in which R is an aliphatic acyl radical having 6 to 22 carbon atoms, $R^1$ is hydrogen, an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxy fatty acid amides are known substances which can usually be obtained by reductive amination of a reducing sugar with ammonia, an alkylamine or an alkanolamine and subsequent acylation with a fatty acid, a fatty acid alkyl ester or a fatty acid chloride.

The group of polyhydroxy fatty acid amides also includes compounds of the formula

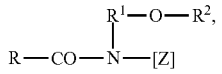

in which R is a linear or branched alkyl or alkenyl radical having 7 to 12 carbon atoms, $R^1$ is a linear, branched or cyclic alkyl radical or an aryl radical having 2 to 8 carbon atoms and $R^2$ is a linear, branched or cyclic alkyl radical or an aryl radical or an oxy-alkyl radical having 1 to 8 carbon atoms, where $C_{1-4}$-alkyl or phenyl radicals are preferred and [Z] is a linear polyhydroxyalkyl radical whose alkyl chain is substituted with at least two hydroxyl groups, or alkoxylated, preferably ethoxylated or propoxylated derivatives of this radical.

[Z] is preferably obtained by reductive amination of a reduced sugar, for example glucose, fructose, maltose, lactose, galactose, mannose or xylose. The N-alkoxy- or N-aryloxy-substituted compounds can be converted to the desired polyhydroxy fatty acid amides by reaction with fatty acid methyl esters in the presence of an alkoxide as catalyst.

Weakly foaming nonionic surfactants are used as preferred surfactants. With particular preference, washing or cleaning compositions, in particular cleaning compositions for washing dishes and, among these, preferably for the machine washing of dishes, comprise nonionic surfactants from the group of alkoxylated alcohols. The nonionic surfactants used are preferably alkoxylated, advantageously ethoxylated, in particular primary alcohols having preferably 8 to 18 carbon atoms and on average 1 to 12 mol of ethylene oxide (EO) per mole of alcohol, in which the alcohol radical may be linear or preferably 2-methyl-branched and/or can contain a mixture of linear and methyl-branched radicals, as is customarily present in oxo alcohol radicals. In particular, however, preference is given to alcohol ethoxylates with linear radicals from alcohols of native origin having 12 to 18 carbon atoms, e.g. from coconut, palm, tallow fatty or oleyl alcohol, and on average 2 to 8 mol of EO per mole of alcohol. The preferred ethoxylated alcohols include for example $C_{12-14}$-alcohols with 3 EO or 4 EO, $C_{9-11}$-alcohol with 7 EO, $C_{13-15}$-alcohols with 3 EO, 5 EO, 7 EO or 8 EO, $C_{12-18}$-alcohols with 3 EO, 5 EO or 7 EO and mixtures of these, such as mixtures of $C_{12-14}$-alcohol with 3 EO and $C_{12-18}$-alcohol with 5 EO. The stated degrees of ethoxylation are statistical average values which can correspond to an integer or a fraction for a specific product. Preferred alcohol ethoxylates have a narrowed homolog distribution (narrow range ethoxylates, NRE). In addition to these nonionic surfactants, it is also possible to use fatty alcohols with more than 12 EO. Examples thereof are tallow fatty alcohol with 14 EO, 25 EO, 30 EO or 40 EO.

Particular preference is therefore given to using ethoxylated nonionic surfactants which have been obtained from $C_{6-20}$-monohydroxyalkanols or $C_{6-20}$-alkylphenols or $C_{16-20}$-fatty alcohols and more than 12 mol, preferably more than 15 mol and in particular more than 20 mol, of ethylene oxide per mole of alcohol. A particularly preferred nonionic surfactant is obtained from a straight-chain fatty alcohol having 16 to 20 carbon atoms ($C_{16-20}$-alcohol), preferably a $C_{18}$-alcohol and at least 12 mol, preferably at least 15 mol and in particular at least 20 mol, of ethylene oxide. Among these, preference is given to the so-called "narrow range ethoxylates".

Furthermore, particular preference is given to using surfactants which comprise one or more tallow fatty alcohols having 20 to 30 EO in combination with a silicone defoamer.

Particular preference is given to nonionic surfactants which have a melting point above room temperature. Nonionic surfactant(s) with a melting point above 20° C., preferably above 25° C., particularly preferably between 25 and 60° C. and in particular between 26.6 and 43.3° C., is/are particularly preferred.

Suitable nonionic surfactants which have melting or softening points in the stated temperature range are, for example, weakly foaming nonionic surfactants, which may be solid or highly viscous at room temperature. If nonionic surfactants are used which are highly viscous at room temperature, then it is preferred for these to have a viscosity above 20 Pa·s, preferably above 35 Pa·s and in particular above 40 Pa·s. Nonionic surfactants which have wax-like consistency at room temperature are also preferred.

Nonionic surfactants from the group of alkoxylated alcohols, particularly preferably from the group of mixed alkoxylated alcohols and in particular from the group of EO-AO-EO nonionic surfactants are likewise used with particular preference.

The nonionic surfactant that is solid at room temperature preferably has propylene oxide units in the molecule. Preferably, such PO units constitute up to 25% by weight, particularly preferably up to 20% by weight and in particular up to 15% by weight, of the total molar mass of the nonionic surfactant. Particularly preferred nonionic surfactants are ethoxylated monohydroxyalkanols or alkylphenols which additionally have polyoxyethylene-polyoxypropylene block copolymer units. The alcohol or alkylphenol moiety of such nonionic surfactant molecules here constitutes preferably more than 30% by weight, particularly preferably more than 50% by weight and in particular more than 70% by weight, of the total molar mass of such nonionic surfactants. Preferred compositions are characterized in that they comprise ethoxylated and propoxylated nonionic surfactants in which the propylene oxide units in the molecule constitute up to 25% by weight, preferably up to 20% by weight and in particular up to 15% by weight of the total molar mass of the nonionic surfactant.

Surfactants to be used with preference originate from the groups of the alkoxylated nonionic surfactants, in particular the ethoxylated primary alcohols and mixtures of these surfactants with surfactants with a more complicated structure such as polyoxypropylene/polyoxyethylene/polyoxypropylene ((PO/EO/PO) surfactants). Such (PO/EO/PO) nonionic surfactants are moreover characterized by good foam control.

Further nonionic surfactants to be used particularly preferably and having melting points above room temperature comprise 40 to 70% of a polyoxypropylene/polyoxyethylene/poly-oxypropylene block polymer blend which comprises 75% by weight of an inverted block copolymer of polyoxyethylene and polyoxypropylene with 17 mol of ethylene oxide and 44 mol of propylene oxide and 25% by weight of a block copolymer of polyoxyethylene and polyoxypropylene, initiated with trimethylolpropane and comprising 24 mol of ethylene oxide and 99 mol of propylene oxide per mole of trimethylolpropane.

Within the context of the present invention, particularly preferred nonionic surfactants have proven to be weakly foaming nonionic surfactants which have alternating ethylene oxide and alkylene oxide units. Among these, preference is in turn given to surfactants with EO-AO-EO-AO blocks, where in each case one to ten EO or AO groups are bonded together, before a block of the respective other groups follows. Here, preference is given to nonionic surfactants of the general formula $$R^1—O—(CH_2—CH_2—O)_w—(CH_2—\underset{\underset{R^2}{|}}{CH}—O)_x—(CH_2—CH_2—O)_y—(CH_2—\underset{\underset{R^3}{|}}{CH}—O)_z—H$$

in which $R^1$ is a straight-chain or branched, saturated or mono- or polyunsaturated $C_{6-24}$-alkyl or -alkenyl radical; each group $R^2$ or $R^3$, independently of one another, is selected from $—CH_3$, $—CH_2CH_3$, $—CH_2CH_2—CH_3$, $CH(CH_3)_2$ and the indices w, x, y, z, independently of one another, are integers from 1 to 6.

The preferred nonionic surfactants of the above formula can be prepared by known methods from the corresponding alcohols $R^1$—OH and ethylene oxide or alkylene oxide. The radical $R^1$ in the formula above can vary depending on the origin of the alcohol. If native sources are used, the radical $R^1$ has an even number of carbon atoms and is generally unbranched, preference being given to the linear radicals from alcohols of native origin having 12 to 18 carbon atoms, e.g. from coconut, palm, tallow fatty or oleyl alcohol. Alcohols accessible from synthetic sources are for example the Guerbet alcohols or 2-methyl-branched or a mixture of linear and methyl-branched radicals, as are usually present in oxo alcohol radicals. Irrespective of the nature of the alcohol used for producing the nonionic surfactants present in the compositions, preference is given to nonionic surfactants in which $R^1$ in the above formula is an alkyl radical having 6 to 24, preferably 8 to 20, particularly preferably 9 to 15 and especially 9 to 11, carbon atoms.

Besides propylene oxide, a suitable alkylene oxide unit which is present as an alternative to the ethylene oxide unit in the preferred nonionic surfactants is in particular butylene oxide. However, further alkylene oxides in which $R^2$ and $R^3$, independently of one another, are selected from $—CH_2CH_2—CH_3$ or $CH(CH_3)_2$ are also suitable. Preference is given to using nonionic surfactants of the above formula in which $R^2$ or $R^3$ is a radical $—CH_3$, w and x, independently of one another, are values of 3 or 4 and y and z, independently of one another are values of 1 or 2.

In summary, preference is given in particular to nonionic surfactants which have a $C_{9-15}$-alkyl radical having 1 to 4 ethylene oxide units, followed by 1 to 4 propylene oxide units, followed by 1 to 4 ethylene oxide units, followed by 1 to 4 propylene oxide units. These surfactants have the required low viscosity in aqueous solution and can be used according to the invention with particular preference.

Surfactants of the general formula $$R^1—CH(OH)CH_2O\text{-}(AO)_w\text{-}(A'O)_x\text{-}(A''O)_y\text{-}(A'''O)_z—R^2, \text{ in which}$$

$R^1$ and $R^2$, independently of one another, is a straight-chain or branched, saturated or mono- or polyunsaturated $C_{2-40}$-alkyl or -alkenyl radical; A, A', A" and A"', independently of one another, is a radical from the group $—CH_2CH_2$, $—CH_2CH_2—CH_2$, $—CH_2—CH(CH_3)$, $—CH_2—CH_2—CH_2—CH_2$, $—CH_2—CH(CH_3)—CH_2—$, $—CH_2—CH(CH_2—CH_3)$; and w, x, y and z are values between 0.5 and 90, where x, y and/or z may also be 0, are particularly preferred according to the invention.

Very particular preference is given here to nonionic surfactants of the general formula $R^1O[CH_2CH(CH_3)O]_x[CH_2CH_2O]_y[CH_2CH(CH_3)O]_zCH_2CH(OH)R^2$, in which $R^1$ is a linear or branched aliphatic hydrocarbon radical having 4 to 22, in particular 6 to 18, carbon atoms or mixtures thereof, $R^2$ is a linear or branched hydrocarbon radical having 2 to 26, in particular 4 to 20, carbon atoms or mixtures thereof, and x and z are values between 0 and 40 and y is a value of at least 15, preferably of 15 to 120, particularly preferably of 20 to 80.

In a preferred embodiment, the dishwashing detergent, in particular the machine dishwashing detergent, comprises, based on its total weight, nonionic surfactant of the general formula $R^1O[CH_2CH(CH_3)O]_x[CH_2CH_2O]_y[CH_2CH(CH_3)O]_zCH_2CH(OH)R^2$ in amounts of from 0.1 to 15% by weight, preferably 0.2 to 10% by weight, particularly preferably 0.5 to 8% by weight and especially from 1.0 to 6% by weight.

Preference is given in particular to those terminally capped poly(oxyalkylated) nonionic surfactants according to the formula $R^1O[CH_2CH_2O]_yCH_2CH(OH)R^2$, in which $R^1$ is a linear or branched aliphatic hydrocarbon radical having 4 to 22, in particular 6 to 16, carbon atoms or mixtures thereof, $R^2$ is a linear or branched hydrocarbon radical having 2 to 26, in particular 4 to 20, carbon atoms or mixtures thereof, and y is a value between 15 and 120, preferably 20 to 100, in particular 20 to 80. The group of these nonionic surfactants includes for example hydroxy mixed ethers of the general formula $C_{6-22}$—$CH(OH)CH_2O$-$(EO)_{20-120}$—$C_{2-26}$, for example the $C_{8-12}$ fatty alcohol-$(EO)_{22}$-2-hydroxydecyl ethers and the $C_{4-22}$ fatty alcohol-$(EO)_{40-80}$-2-hydroxyalkyl ethers.

Dishwashing detergents according to the invention, in particular machine dishwashing detergents, wherein the weakly foaming nonionic surfactant used is a surfactant of the general formula $R^1CH(OH)CH_2O$—$(CH_2CH_2O)_{20-120}$—$R^2$, where $R^1$ and $R^2$, independently of one another, are a linear or branched aliphatic hydrocarbon radical having 2 to 20, in particular 4 to 16, carbon atoms, are particularly preferred.

Preference is also given to surfactants of the formula $R^1O[CH_2CH(CH_3)O]_x[CH_2CH_2O]_yCH_2CH(OH)R^2$, in which $R^1$ is a linear or branched aliphatic hydrocarbon radical having 4 to 22 carbon atoms or mixtures thereof, $R^2$ is a linear or branched hydrocarbon radical having 2 to 26 carbon atoms or mixtures thereof, and x is values between 0.5 and 4, preferably 0.5 to 1.5, and y is a value of at least 15.

According to the invention, preference is furthermore also given to surfactants of the general formula $R^1O[CH_2CH(CH_3)O]_x[CH_2CH_2O]_yCH_2CH(OH)R^2$, in which $R^1$ is a linear or branched aliphatic hydrocarbon radical having 4 to 22 carbon atoms or mixtures thereof, $R^2$ is a linear or branched hydrocarbon radical having 2 to 26 carbon atoms or mixtures thereof, and x is a value between 1 and 40 and y is a value between 15 and 40, where the alkylene units $[CH_2CH(CH_3)O]$ and $[CH_2CH_2O]$ are present in a randomized manner, i.e. in the form of a statistical, random distribution.

The group of preferred terminally capped poly(oxyalkylated) nonionic surfactants also includes nonionic surfactants of the formula $R^1O[CH_2CH_2O]_x[CH_2CH(R^3)O]_yCH_2CH(OH)R^2$, in which $R^1$ and $R^2$, independently of one another, are a linear or branched, saturated or mono- or polyunsaturated hydrocarbon radical having 2 to 26 carbon atoms, $R^3$, independently of the others, is selected from —$CH_3$, —$CH_2CH_3$, —$CH_2CH_2$—$CH_3$, —$CH(CH_3)_2$, but is preferably —$CH_3$, and x and y, independently of one another, are values between 1 and 32, where nonionic surfactants where $R^3$=—$CH_3$ and values of x from 15 to 32 and y of 0.5 and 1.5 are very particularly preferred.

Further nonionic surfactants that can be used with preference are the terminally capped poly(oxyalkylated) nonionic surfactants of the formula $$R^1O[CH_2CH(R^3)O]_x[CH_2]_kCH(OH)[CH_2]_jOR^2,$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x is values between 1 and 30, k and j are values between 1 and 12, preferably between 1 and 5. If the value x is ≥2, each $R^3$ in the above formula $R^1O[CH_2CH(R^3)O]_x[CH_2]_kCH(OH)[CH_2]_jOR^2$ can be different. $R^1$ and $R^2$ are preferably linear or branched, saturated or unsaturated, aliphatic or aromatic hydrocarbon radicals having 6 to 22 carbon atoms, where radicals having 8 to 18 carbon atoms are particularly preferred. For the radical $R^3$, H, —$CH_3$ or —$CH_2CH_3$ are particularly preferred. Particularly preferred values for x are in the range from 1 to 20, in particular from 6 to 15.

As described above, each $R^3$ in the aforementioned formula can be different if x is ≥2. As a result, the alkylene oxide unit in the square brackets can be varied. If, for example, x is 3, the radical $R^3$ can be selected in order to form ethylene oxide ($R^3$=H) or propylene oxide ($R^3$=$CH_3$) units joined together in any order, for example (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and can of course be larger, the scope of variation increasing with increasing x values and including for example a large number of (EO) groups, combined with a small number of (PO) groups, or vice versa.

Particularly preferred terminally capped poly(oxyalkylated) alcohols of the above formula have values of k=1 and j=1, meaning that the above formula is simplified to $$R^1O[CH_2CH(R^3)O]_xCH_2CH(OH)CH_2OR^2.$$

In the last-mentioned formula, $R^1$, $R^2$ and $R^3$ are as defined above and x is numbers from 1 to 30, preferably from 1 to 20 and in particular from 6 to 18. Particular preference is given to surfactants in which the radicals $R^1$ and $R^2$ have 9 to 14 carbon atoms, $R^3$ is H and x assumes values from 6 to 15.

Further preferably used nonionic surfactants are nonionic surfactants of the general formula $$R^1O(AlkO)_xM(OAlk)_yOR^2, \text{ where}$$

$R^1$ and $R^2$, independently of one another, are a branched or unbranched, saturated or unsaturated, optionally hydroxylated alkyl radical having 4 to 22 carbon atoms;

Alk is a branched or unbranched alkyl radical having 2 to 4 carbon atoms;

x and y, independently of one another, are values between 1 and 70; and

M is an alkyl radical from the group $CH_2$, $CHR^3$, $CR^3R^4$, $CH_2CHR^3$ and $CHR^3CHR^4$, where $R^3$ and $R^4$, independently of one another, are a branched or unbranched, saturated or unsaturated alkyl radical having 1 to 18 carbon atoms.

Preference is given here to nonionic surfactants of the general formula $$R^1—CH(OH)CH_2—O(CH_2CH_2O)_xCH_2CHR(OCH_2CH_2)_yO—CH_2CH(OH)—R^2, \text{ where}$$

R, $R^1$ and $R^2$, independently of one another, are an alkyl radical or alkenyl radical having 6 to 22 carbon atoms;

x and y, independently of one another, are values between 1 and 40.

Preference is given here in particular to compounds of the general formula $R^1$—$CH(OH)CH_2$—$O(CH_2CH_2O)_xCH_2CHR(OCH_2CH_2)_yO$—$CH_2CH(OH)$—$R^2$, in which R is a linear, saturated alkyl radical having 8 to 16 carbon atoms, preferably 10 to 14 carbon atoms, and n and m, independently of one another, have values from 20 to 30. Corresponding compounds can be obtained for example by reacting alkyldiols HO—CHR—$CH_2$—OH with ethylene oxide, where afterwards a reaction with an alkyl epoxide takes place for closure of the free OH functions with the formation of a dihydroxy ether.

In a further preferred embodiment, the nonionic surfactant is selected from nonionic surfactants of the general formula $R^1—O(CH_2CH_2O)_xCR^3R^4(OCH_2CH_2)_yO—R^2$, in which $R^1$ and $R^2$, independently of one another, are an alkyl radical or alkenyl radical having 4 to 22 carbon atoms;

$R^3$ and $R^4$, independently of one another, are H or an alkyl radical or alkenyl radical having 1 to 18 carbon atoms and x and y, independently of one another, are values between 1 and 40.

Preference is given here in particular to compounds of the general formula $R^1—O(CH_2CH_2O)_xCR^3R^4(OCH_2CH_2)_yO—R^2$, in which $R^3$ and $R^4$ are H and the indices x and y, independently of one another, assume values from 1 to 40, preferably from 1 to 15.

Particular preference is given in particular to compounds of the general formula $R^1—O(CH_2CH_2O)_xCR^3R^4(OCH_2CH_2)_yO—R^2$, in which the radicals $R^1$ and $R^2$, independently of one another, are saturated alkyl radicals having 4 to 14 carbon atoms and the indices x and y, independently of one another, assume values from 1 to 15 and in particular from 1 to 12.

Preference is furthermore given to those compounds of the general formula $R^1—O(CH_2CH_2O)_xCR^3R^4(OCH_2CH_2)_yO—R^2$, in which one of the radicals $R^1$ and $R^2$ is branched.

Very particular preference is given to compounds of the general formula $R^1—O(CH_2CH_2O)_xCR^3R^4(OCH_2CH_2)_yO—R^2$, in which the indices x and y, independently of one another, assume values from 8 to 12.

The stated carbon chain lengths and degrees of ethoxylation or degrees of alkoxylation of the aforementioned nonionic surfactants are statistical average values which may be an integer or a fraction for a specific product. On account of the production processes, commercial products of said formulae consist mostly not of an individual representative, but of mixtures, as a result of which average values and consequently fractional numbers can arise both for the carbon chain lengths and also for the degrees of ethoxylation or degrees of alkoxylation.

The aforementioned nonionic surfactants can of course be used not only as individual substances, but also as surfactant mixtures of two, three, four or more surfactants. In this connection, "surfactant mixtures" is the term not used to refer to mixtures of nonionic surfactants which fall in their totality under one of the aforementioned general formulae, but rather those mixtures which contain two, three, four or more nonionic surfactants which can be described by various of the aforementioned general formulae.

Particular preference is given to those nonionic surfactants which have a melting point above room temperature. Nonionic surfactant(s) with a melting point above 20° C., preferably above 25° C., particularly preferably between 25 and 60° C. and in particular between 26.6 and 43.3° C., is/are particularly preferred.

The weight fraction of the nonionic surfactant of the total weight of the dishwashing detergent according to the invention, in particular machine dishwashing detergent, is, in a preferred embodiment, from 0.1 to 20% by weight, particularly preferably from 0.5 to 15% by weight, in particular from 2.5 to 10% by weight.

In a preferred embodiment, the % by weight ratio of anionic surfactant with at least one sulfate or sulfonate group to nonionic surfactant is from 3:1 to 1:3, in particular from 2:1 to 1:2, particularly preferably from 1.5:1 to 1:1.5, Dishwashing detergents according to the invention, in particular machine dishwashing detergents, comprise at least one anionic polymer as further constituent in a preferred embodiment. Preferred anionic polymers here are the copolymeric polycarboxylates and the copolymeric polysulfonates.

The weight fraction of the anionic polymer of the total weight of the dishwashing detergent according to the invention, in particular machine dishwashing detergent, in a preferred embodiment is from 0.1 to 20% by weight, preferably from 0.5 to 18% by weight, particularly preferably from 1.0 to 15% by weight and in particular from 4 to 14% by weight.

Dishwashing detergents according to the invention, in particular machine dishwashing detergents, wherein the copolymeric anionic polymer is selected from the group of hydrophobically modified polycarboxylates and polysulfonates is a particularly preferred subject matter since an improvement in the clear-rinsing and drying properties of these compositions with simultaneously low filming can be achieved through the hydrophobic modification of the anionic copolymers.

The copolymers can have two, three, four or more different monomer units.

Besides monomer(s) containing sulfonic acid groups, preferred copolymeric polysulfonates contain at least one monomer from the group of unsaturated carboxylic acids.

The unsaturated carboxylic acid(s) used is/are particularly preferably unsaturated carboxylic acids of the formula $R^1(R^2)C{=}C(R^3)COOH$, in which $R^1$ to $R^3$, independently of one another, is —H, $—CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above substituted with $—NH_2$, —OH or —COOH, or —COOH or $—COOR^4$, where $R^4$ is a saturated or unsaturated, straight-chain or branched hydrocarbon radical having 1 to 12 carbon atoms.

Particularly preferred unsaturated carboxylic acids are acrylic acid, methacrylic acid, ethacrylic acid, □-chloroacrylic acid, □-cyanoacrylic acid, crotonic acid, □-phenylacrylic acid, maleic acid, maleic anhydride, fumaric acid, itaconic acid, citraconic acid, methylene malonic acid, sorbic acid, cinnamic acid or mixtures thereof. It is of course also possible to use the unsaturated dicarboxylic acids.

Copolymeric polycarboxylates which are used particularly preferably according to the invention are copolymers of acrylic acid with methacrylic acid and of acrylic acid or methacrylic acid with maleic acid. Copolymers of acrylic acid with maleic acid which comprise 50 to 90% by weight of acrylic acid and 50 to 10% by weight of maleic acid have proven to be particularly suitable. Their relative molecular mass, based on free acids, is generally 2000 to 70 000 g/mol, preferably 20 000 to 50 000 g/mol and in particular 30 000 to 40 000 g/mol.

For the purposes of this document, the stated molar masses are weight-average molar masses Mw, which were determined in principle by means of gel permeation chromatography (GPC), using a UV detector. Measurement was carried out against an external standard which, on account of its structural similarity to the investigated polymers, produces realistic molecular weight values.

The monomers containing sulfonic acid groups are preferably those of the formula $R^5(R^6)C{=}C(R^7)—X—SO_3H$ in which $R^5$ to $R^7$, independently of one another, are —H, —$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals substituted with —$NH_2$, —OH or —COOH, or —COOH or —$COOR^4$, where $R^4$ is a saturated or unsaturated, straight-chain or branched hydrocarbon radical having 1 to 12 carbon atoms, and X is an optionally present spacer group which is selected from —$(CH_2)_n$— where n=0 to 4, —COO—$(CH_2)_k$— where k=1 to 6, —C(O)—NH—$C(CH_3)_2$—, —C(O)—NH—$C(CH_3)_2$—$CH_2$— and —C(O)—NH—$CH(CH_3)$—$CH_2$—.

Among these monomers, preference is given to those of the formulae $$H_2C{=}CH{-}X{-}SO_3H$$

$$H_2C{=}C(CH_3){-}X{-}SO_3H$$

$$HO_3S{-}X{-}(R^6)C{=}C(R^7){-}X{-}SO_3H,$$

in which $R^6$ and $R^7$, independently of one another, are selected from —H, —$CH_3$, —$CH_2CH_3$, —$CH_2CH_2CH_3$ and —$CH(CH_3)_2$ and X is an optionally present spacer group which is selected from —$(CH_2)_n$— where n=0 to 4, —COO—$(CH_2)_k$— where k=1 to 6, —C(O)—NH—$C(CH_3)_2$—, —C(O)—NH—$C(CH_3)_2$—$CH_2$— and —C(O)—NH—$CH(CH_3)$—$CH_2$—.

Particularly preferred monomers containing sulfonic acid groups here are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 3-sulfopropyl methacrylate, sulfomethacrylamide, sulfomethylmethacrylamide, and mixtures of said acids or water-soluble salts thereof.

In the polymers, the sulfonic acid groups can be present in completely or partially neutralized form, this means that the acidic hydrogen atom of the sulfonic acid group can be replaced in some or all sulfonic acid groups by metal ions, preferably alkali metal ions and in particular by sodium ions. The use of partially or completely neutralized copolymers containing sulfonic acid groups is preferred according to the invention.

The monomer distribution of the copolymers preferably used according to the invention in the case of copolymers which comprise only monomers containing carboxylic acid groups and monomers containing sulfonic acid groups is preferably in each case 5 to 95% by weight, particularly preferably the fraction of the monomer containing sulfonic acid groups is 50 to 90% by weight and the fraction of the monomer containing carboxylic acid groups is 10 to 50% by weight, the monomer here preferably being selected from those specified above.

The molar mass of the sulfocopolymers preferably used according to the invention can be varied in order to adapt the properties of the polymers to the desired intended use. Preferred dishwashing detergents, in particular machine dishwashing detergents, are those wherein the copolymers have molar masses of from 2000 to 200 000 $gmol^{-1}$, preferably from 4000 to 25 000 $gmol^{-1}$ and in particular from 5000 to 15 000 $gmol^{-1}$.

In a further preferred embodiment, as well as monomer containing carboxyl groups and monomer containing sulfonic acid groups, the copolymers furthermore comprise at least one nonionic, preferably hydrophobic monomer. The use of these hydrophobically modified polymers enabled in particular the clear-rinse performance of machine dishwashing detergents according to the invention to be improved.

Dishwashing detergents, in particular machine dishwashing detergents, wherein the dishwashing detergent comprises, as anionic copolymer, a copolymer comprising i) monomer(s) containing carboxylic acid groups
ii) monomer(s) containing sulfonic acid groups
iii) nonionic monomer(s)

are preferred according to the invention.

The nonionic monomers used are preferably monomers of the general formula $R^1(R^2)C{=}C(R^3){-}X{-}R^4$, in which $R^1$ to $R^3$, independently of one another, is —H, —$CH_3$ or —$C_2H_5$, X is an optionally present spacer group which is selected from —$CH_2$—, —C(O)O— and —C(O)—NH—, and $R^4$ is a straight-chain or branched saturated alkyl radical having 2 to 22 carbon atoms or is an unsaturated, preferably aromatic radical having 6 to 22 carbon atoms.

Particularly preferred nonionic monomers are butene, isobutene, pentene, 3-methylbutene, 2-methylbutene, cyclopentene, hexene, hexene-1,2-methlypentene-1,3-methlypentene-1, cyclohexene, methylcyclopentene, cycloheptene, methylcyclohexene, 2,4,4-trimethylpentene-1,2,4,4-trimethylpentene-2,2,3-dimethylhexene-1,2,4-diemthylhexene-1,2,5-dimethlyhexene-1,3,5-dimethylhexene-1,4,4-dimethylhexane-1, ethylcyclohexyne, 1-octene, □-olefin with 10 or more carbon atoms such as, for example, 1-decene, 1-dodecene, 1-hexadecene, 1-octadecene and C22-□-olefin, 2-styrene, □-methylstyrene, 3-methylstyrene, 4-propylstryene, 4-cyclohexylstyrene, 4-dodecylstyrene, 2-ethyl-4-benzylstyrene, 1-vinylnaphthalene, 2-vinylnaphthalene, methyl acrylate, ethyl acrylate, propyl acrylate, butyl acrylate, pentyl acrylate, hexyl acrylate, methyl methacrylate, N-(methyl) acrylamide, 2-ethylhexyl acrylate, 2-ethylhexyl methacrylate, N-(2-ethylhexyl)acrylamide, octyl acrylate, octyl methacrylate, N-(octyl)acrylamide, lauryl acrylate, lauryl methacrylate, N-(lauryl)acrylamide, stearyl acrylate, stearyl methacrylate, N-(stearyl)acrylamide, behenyl acrylate, behenyl methacrylate and N-(behenyl)acrylamide or mixtures thereof.

In a further embodiment of the invention, a dishwashing detergent according to the invention is notable for the fact that it comprises at least one further enzyme, in particular a protease, amylase, cellulase, pectin-cleaving enzyme, hemicellulase, mannanase, tannase, xylanase, xanthanase, β-glucosidase, carrageenase, perhydrolase, oxidase, oxidoreductase or a lipase, and combinations thereof, in particular a combination which is selected from protease and amylase, protease and lipase, protease and cellulase, protease and mannanase, amylase and lipase, amylase and cellulase, amylase and mannanase, lipase and cellulase, lipase and mannanase, lipase and cellulase, protease and amylase and lipase, protease and amylase and cellulase, protease and amylase and mannanase, amylase and lipase and cellulase, amylase and lipase and mannanase, lipase, cellulase and mannanase, protease and amylase and lipase and cellulase, protease and amylase and cellulase and mannanase.

A further enzyme of this type is advantageously present in the composition in each case in an amount of $1\times10^{-8}$ to 5 percent by weight, based on active protein. Increasingly preferably, each further enzyme is present in compositions according to the invention in an amount of $1\times10^{-7}$-3% by weight, from 0.00001-1% by weight, from 0.00005-0.5% by weight, from 0.0001 to 0.1% by weight and particularly preferably from 0.0001 to 0.05% by weight, based on active protein. The active protein concentration can be determined in this regard in the customary manner, in the case of hydrolases for example via a titration of the active centers using a suitable irreversible inhibitor and determining the residual activity (cf. for example M. Bender et al., J. Am. Chem. Soc. 88, 24 (1966), pp. 5890-5913; the cited reference relates to proteases, although the principle of the titration of the active centers can be applied to other hydrolases). Particularly preferably, the enzymes exhibit synergistic detergencies towards certain stains or marks, i.e. the enzymes present in the composition mutually assist one another in their detergency. Very particularly preferably, such a synergy is present between the protease present according to the invention and a further enzyme of a composition according to the invention, including in particular between the protease present according to the invention and an amylase and/or a lipase and/or a mannanase and/or a cellulase and/or a pectin-cleaving enzyme. Synergistic effects can arise not only between different enzymes, but also between one or more enzymes and further ingredients of the composition according to the invention.

Among the proteases, preference is given to those of the subtilisin type. Examples thereof are the subtilisins BPN' and Carlsberg, the protease PB92, the subtilisins 147 and 309, the alkaline protease from *Bacillus lentus*, subtilisin DY and the enzymes thermitase, proteinase K and the proteases TW3 and TW7 that are classed as subtilases, but no longer as subtilisins in the narrower sense. Subtilisin Carlsberg is available in further developed form under the trade name Alcalase® from Novozymes A/S, Bagsvrd, Denmark. The subtilisins 147 and 309 are sold under the trade names Esperase®, or Savinase® by Novozymes. The protease variants listed under the name BLAP® are derived from the protease from *Bacillus lentus* DSM 5483. Further preferred proteases are also for example the enzymes listed under the name PUR. Further proteases are also the enzymes available under the trade names Durazym®, Relase®, Everlase®, Nafizym®, Natalase®, Kannase® and Ovozyme® from Novozymes, the enzymes available under the trade names Purafect®, Purafect® OxP, Purafect® Prime, Excellase® and Properase® from Genencor, the enzyme available under the trade name Protosol® from Advanced Biochemicals Ltd., Thane, India, the enzyme available under the trade name Wuxi® from Wuxi Snyder Bioproducts Ltd., China, the enzymes available under the trade name Proleather® and Protease P® from Amano Pharmaceuticals Ltd., Nagoya, Japan, and the enzyme available under the name Proteinase K-16 from Kao Corp., Tokyo, Japan. Particular preference is also given to using the proteases from *Bacillus gibsonii* and *Bacillus pumilus*, which are disclosed in the International patent applications WO 2008/086916 and WO 2007/131656.

Amylases which can be formulated according to the invention are for example the α-amylases from *Bacillus licheniformis*, from *Bacillus amyloliquefaciens* or from *Bacillus stearothermophilus*, and in particular also their further developments improved for use in washing or cleaning compositions. The enzyme from *Bacillus licheniformis* is available from the company Novozymes under the name Termamyl® and from the company Danisco/Genencor under the name Purastar®ST. Further development products of this α-amylase are available from the company Novozymes under the trade name Duramyl® and Termamyl®ultra, from the company Danisco/Genencor under the name Purastar®OxAm and from the company Daiwa Seiko Inc., Tokyo, Japan, as Keistase®. The α-amylase from *Bacillus amyloliquefaciens* is sold by the company Novozymes under the name BAN®, and derived variants of the α-amylase from *Bacillus stearothermophilus* under the names BSG® and Novamyl®, likewise from the company Novozymes. Furthermore, the α-amylase from *Bacillus* sp. A 7-7 (DSM 12368) and the cyclodextrin glucanotransferase (CGTase) from *Bacillus agaradherens* (DSM 9948) are to be emphasized for this purpose. Fusion products of all of the stated molecules can likewise be used. Moreover, the further developments of the α-amylase from *Aspergillus niger* and *A. oryzae* available under the trade names Fungamyl® from the company Novozymes are suitable. Further commercial products that can be used advantageously are, for example, the Amylase-LT® and Stainzyme® or Stainzyme ultra® or Stainzyme plus®, the latter likewise from the company Novozymes. Variants of these enzymes available by point mutations can also be used according to the invention. Particularly preferred amylases are disclosed in the International laid-open specifications WO 00/60060, WO 03/002711, WO 03/054177 and WO 07/079938, to the disclosure of which reference is therefore expressly made or whose disclosure content in this regard is thereby expressly incorporated into the present patent application. Amylases which can be formulated according to the invention are also preferably α-amylases.

Examples of lipases or cutinases which can be formulated according to the invention that are present in particular on account of their triglyceride-cleaving activities, but also in order to generate peracids in situ from suitable precursors are the lipases obtainable, or further developed, originally from *Humicola lanuginosa* (*Thermomyces lanuginosus*), in particular those with the amino acid exchange D96L. They are sold for example by Novozymes under the trade names Lipolase®, Lipolase®Ultra, LipoPrime®, Lipozyme® and Lipex®. Furthermore, the cutinases which have originally been isolated from *Fusarium solani* pisi and *Humicola insolens* for example can be used. From the company Genencor, for example the lipases or cutinases can be used whose starting enzymes have originally been isolated from *Pseudomonas mendocina* and *Fusarium solanii*. Further important commercial products to be mentioned are the preparations M1 Lipase® and Lipomax® sold by Gist-Brocades and the enzymes sold by Meito Sangyo KK, Japan, under the names Lipase MY-30®, Lipase OF® and Lipase PL®, also the product Lumafast® from Genencor.

Cellulases that can be formulated according to the invention (endoglucanases, EG) comprise for example the fungal endoglucanase (EG)-rich cellulose preparation or its further developments which are supplied from the company Novozymes under the trade name Celluzyme®. The products Endolase® and Carezyme® likewise available from the company Novozymes are based on the 50 kD-EG, or the 43 kD-EG from Humicola insolens DSM 1800. Further commercial products from this company that can be used are Cellusoft®, Renozyme® and Celluclean®. It is furthermore possible to use for example cellulases which are available from the company AB Enzymes, Finland, under the trade names Ecostone® and Biotouch®, and which are based at least partly on the 20 kD-EG from Melanocarpus. Further cellulases from the company AB Enzymes are Econase® and Ecopulp®. Further suitable cellulases are from *Bacillus* sp. CBS 670.93 and CBS 669.93, where the CBS 670.93 from *Bacillus* sp. is available from the company Danisco/Genencor under the trade name Puradax®. Further commercial products that can be used from the company Danisco/Genencor are "Genencor detergent cellulase L" and IndiAge®Neutra. Variants of these enzymes obtainable by point mutations can also be used according to the invention. Particularly preferred cellulases are *Thielavia terrestris* cellulase variants which are disclosed in the International laid-open specification WO 98/12307, cellulases from Melanocarpus, in particular *Melanocarpus albomyces*, which are disclosed in the International laid-open specification WO 97/14804, cellulases of the EGIII type from *Trichoderma reesei*, which are disclosed in the European patent application EP 1 305 432 and variants available therefrom, in particular those which are disclosed in the European patent applications EP 1240525 and EP 1305432, and also cellulases which are disclosed in the International laid-open specifications WO 1992006165, WO 96/29397 and WO 02/099091. Reference is therefore expressly made to their respective disclosure and/or their disclosure content in this regard is therefore expressly incorporated into the present patent application.

Pectin-cleaving enzymes (pectinases) for the purposes of the invention are enzymes which cleave pectins and/or other galacturonans. Pectins are polysaccharides whose main constituent is α-D-galacturonic acid as monomer, preferably to at least 50% by weight and particularly preferably to at least 65% by weight. These galacturonic acid monomers are joined together via α-1,4-, sometimes also to a small extent via β-1,4-glycosidic bonds, and form the backbone of the pectin molecule, which is interrupted periodically by 1,2-bonds with α-L-rhamnose. A pectin is consequently a rhamnogalacturonic acid. A pectin-cleaving enzyme is consequently in particular an enzyme which catalyses the hydrolysis of 1,4-α-D-galactosiduronic bonds.

Within the EC classification of enzymes, the numeric classification system for enzymes, the pectin-cleaving enzymes are in particular affiliated to the enzyme classes ("Enzyme Commission number") EC 3.1.1.11, EC 3.2.1.15, EC 3.2.1.67 and EC 3.2.1.82 and consequently belong to the third of the six enzyme main classes, the hydrolases (E.C.3.-.-.-), among these to the glycosylases (E.C. 3.2.-.-) and in turn among these to the glycosidases (E.C. 3.2.1.-), i.e. the enzymes which hydrolyze O- and/or S-glycosyl compounds. Pectin-cleaving enzymes are consequently effective in particular against residues on dishes which comprise pectinic acid and/or other galacturonanes, and catalyse their hydrolysis.

Within the context of the present invention, the pectin-cleaving enzymes likewise include enzymes with the names pectinase, pectate lyase, pectin esterase, pectin demethoxylase, pectin methoxylase, pectin methylesterase, pectase, pectin methylesterase, pectinoesterase, pectin pectylhydrolase, pectin depolymerase, endopolygalacturonase, pectolase, pectinhydrolase, pectin polygalacturonase, endo-polygalacturonase, poly-α-1,4-galacturonide glycanohydrolase, endogalacturonase, endo-D-galacturonase, galacturan 1,4-α-galacturonidase, exopolygalacturonase, poly(galacturonate) hydrolase, exo-D-galacturonase, exo-D-galacturonanase, exopoly-D-galacturonase, exo-poly-α-galacturonosidase, exopolygalacturonosidase or exopolygalacturanosidase.

Examples of enzymes suitable in this regard are available for example under the names Gamanase®, Pektinex AR®, X-Pect® or Pectaway® from the company Novozymes, under the names Rohapect UF®, Rohapect TPL®, Rohapect PTE100®, Rohapect MPE®, Rohapect MA plus HC, Rohapect DA12L®, Rohapect 10L®, Rohapect B1 L® from the company AB Enzymes and under the name Pyrolase® from the company Diversa Corp., San Diego, Calif., USA.

Furthermore, further enzymes can be used in particular for removing certain problem stains, these are summarized under the term hemicellulases. These include for example mannanases, xanthanlyases, xanthanases, xyloglucanases, xylanases, pullulanases and β-glucanases. The β-glucanase obtained from *Bacillus subtilis* is available under the name Cereflo® from Novozymes. Hemicellulases that are particularly preferred according to the invention are mannanases, which are sold for example under the trade names Mannaway® by the company Novozymes or Purabrite® from the company Genencor.

To increase the bleaching effect, a dishwashing detergent according to the invention can also comprise oxidoreductases, for example oxidases, oxygenases, catalases (which react at low $H_2O_2$ concentrations as peroxidase), peroxidases, such as halo-, chloro-, bromo-, lignin-, glucose or manganese peroxidases, dioxygenases or laccases (phenoloxidases, polyphenoloxidases). Suitable commercial products to be mentioned are Denilite® 1 and 2 from Novozymes. As example systems of an enzymatic perhydrolysis that can be used advantageously, reference is made to the applications WO 98/45398 A1, WO 2005/056782 A2 and WO 2004/058961 A1. A combined enzymatic bleaching system comprising an oxidase and a perhydrolase is described in the application WO 2005/124012. Advantageously, organic, particularly preferably aromatic, compounds which interact with the enzymes are preferably additionally added in order to boost the activity of the oxidoreductases in question (enhancers) or in order to ensure the flow of electrons in the case of highly different redox potentials between the oxidizing enzymes and the stains (mediators).

The enzymes to be used according to the invention can also be formulated together with accompanying substances, for example from the fermentation, or with stabilizers, and be incorporated into a dishwashing detergent according to the invention in a formulation form of this type.

The active ingredient combinations described above are particularly suitable for removing bleachable stains, in particular tea stains, in dishwashing processes, in particular in machine dishwashing processes.

The invention therefore further provides a method for removing stains, in particular custard stains, on hard surfaces, in particular dishes, comprising one of the steps (a) bringing the hard surface into contact with a cleaning liquor which comprises a dishwashing detergent according to the invention, or
(b) bringing the hard surface into contact with a cleaning liquor which comprises a protease which comprises an amino acid sequence which is at least 80% identical to the amino acid sequence given in SEQ ID NO. 1 and which has the amino acid glutamic acid (E) or aspartic acid (D) at position 99 in the count according to SEQ ID NO. 1.

It is preferably a machine dishwashing process. The predosed dishwashing detergent is preferably introduced into the inside of a dishwasher during the progress of a dishwashing program, before the start of the main wash cycle or in the course of the main wash cycle. The dosing in or the introduction of the composition according to the invention into the inside of the dishwasher can take place manually, although the composition is preferably dosed into the inside of the dishwasher by means of the dosing chamber of the dishwasher. In the course of the cleaning process, no additional water softener and no additional rinse aid are preferably dosed into the inside of the dishwasher. Preferably, it is a process for removing custard stains, in particular burnt-on custard stains.

All facts, subject matter and embodiments described for dishwashing detergents according to the invention can also be applied to processes according to the invention. Consequently, at this point, reference is made expressly to the disclosure at the corresponding place with the indication that this disclosure also applies to the aforementioned processes according to the invention.

The invention further provides the use of a dishwashing detergent according to the invention for removing stains, in particular custard stains, on hard surfaces, or a protease which comprises an amino acid sequence which is at least 80% identical to the amino acid sequence given in SEQ ID NO. 1 and which has the amino acid glutamic acid (E) or aspartic acid (D) at position 99 in the count according to SEQ ID NO. 1, for removing stains, in particular custard stains, on hard surfaces.

Preferably, the use relates to the removal of custard stains, in particular burnt-on custard stains. All facts, subject matters and embodiments which have been described for dishwashing detergents according to the invention or processes according to the invention are also applicable to said uses. Consequently, at this point reference is made expressly to the disclosure at the corresponding places with the indication that this disclosure also applies to the aforementioned uses according to the invention.

EXAMPLES

Example 1

Ascertaining the Detergency of Dishwashing Detergents According to the Invention Preparation of the Burnt-On Custard Stain:

The custard stain consists of full egg, cream, milk and sugar. The milk is brought to boiling, then cream and sugar are stirred in and dissolved. The egg yolk is then added and the mixture is carefully boiled again with stirring. 3.5 g of the mixture are then placed onto porcelain plates. After application, the mass is dried on at room temperature until the following day and then burnt on for 2 hours at 140° C. in a drying cabinet.

Ascertaining the Detergency

The detergency on burnt-on custard stains (preparation as described) and also on egg stains of a machine dishwasher in the form of a two-phase dishwasher tablet which comprised 14.6% by weight of sodium percarbonate as hydrogen peroxide source (bleach), 0.03% by weight of bleach-boosting transition metal complex Mn-Me-TACN as bleach catalyst and 2.4% by weight of TAED as bleach activator, was tested, to which in each case protease granules with different proteases as given below in table 1 were added. In this connection, the Protease Blaze Evity® (Novozymes) was used as reference, which is one of the currently highest performing proteases for corresponding dishwashing detergents. The dishwashing detergent according to the invention comprised a protease according to SEQ ID NO. 2, which agrees with SEQ ID NO. 1 in positions 1-98 and 100 to 269 and which has the amino acid glutamic acid (E) at position 99 in the count according to SEQ ID NO. 1. The dishwashing process was carried out in a dishwasher, model Miele G698SC (program: 50° C., program time 57 min, water hardness 21° German hardness). The dishwasher detergent tablet was placed into the dosing device before the start of the wash program.

In each case, 3 determinations were carried out. Each experiment was counted and the average was calculated at the end. The detergency was evaluated visually on a scale from 1 to 10, with 10 being the best grade (no visible residue) and a difference of 1 being significant. The results are shown in table 1 below.

TABLE 1

| | Burnt-on custard | Egg yolk |
|---|---|---|
| Dishwasher tablet without enzymes | 0.3 | 1.5 |
| Control: dishwasher tablet with 0.05 g of the Protease Blaze Evity ® 100T (Novozymes) | 6.7 | 9.7 |
| Dishwashing detergent according to the invention: dishwasher tablet with 0.024 g of a protease according to SEQ ID NO. 2. | 7.7 | 7.5 |

As the results show, the burnt-on custard is a very stubborn stain which cannot be removed without enzymes. Surprisingly, the dishwashing detergent according to the invention exhibits a significantly better detergency on burnt-on custard although a smaller amount of protease (only ca. 50% compared to the control) was used. Furthermore, the dishwashing detergent according to the invention likewise exhibits a very good, advantageous detergency on egg yolk since the reference enzyme Blaze Evity® was used in twice the amount, meaning that the reason for the alleged better performance (9.7 versus 7.5) is merely the larger use amount of the protease. It is thus evident that a dishwashing detergent according to the invention has considerably improved detergency, particularly on stubborn stains such as a burnt-on custard stain.

SEQUENCE LISTING

```
<160> NUMBER OF SEQ ID NOS: 3

<210> SEQ ID NO 1
<211> LENGTH: 269
<212> TYPE: PRT
<213> ORGANISM: Bacillus lentus

<400> SEQUENCE: 1

Ala Gln Ser Val Pro Trp Gly Ile Ser Arg Val Gln Ala Pro Ala Ala
1               5                   10                  15

His Asn Arg Gly Leu Thr Gly Ser Gly Val Lys Val Ala Val Leu Asp
            20                  25                  30

Thr Gly Ile Ser Thr His Pro Asp Leu Asn Ile Arg Gly Gly Ala Ser
```

```
        35                  40                  45

Phe Val Pro Gly Glu Pro Ser Thr Gln Asp Gly Asn Gly His Gly Thr
    50                  55                  60

His Val Ala Gly Thr Ile Ala Ala Leu Asn Asn Ser Ile Gly Val Leu
65                  70                  75                  80

Gly Val Ala Pro Ser Ala Glu Leu Tyr Ala Val Lys Val Leu Gly Ala
                85                  90                  95

Asp Gly Arg Gly Ala Ile Ser Ser Ile Ala Gln Gly Leu Glu Trp Ala
            100                 105                 110

Gly Asn Asn Gly Met His Val Ala Asn Leu Ser Leu Gly Ser Pro Ser
        115                 120                 125

Pro Ser Ala Thr Leu Glu Gln Ala Val Asn Ser Ala Thr Ser Arg Gly
    130                 135                 140

Val Leu Val Val Ala Ala Ser Gly Asn Ser Gly Ala Ser Ser Ile Ser
145                 150                 155                 160

Tyr Pro Ala Arg Tyr Ala Asn Ala Met Ala Val Gly Ala Thr Asp Gln
                165                 170                 175

Asn Asn Asn Arg Ala Ser Phe Ser Gln Tyr Gly Ala Gly Leu Asp Ile
            180                 185                 190

Val Ala Pro Gly Val Asn Val Gln Ser Thr Tyr Pro Gly Ser Thr Tyr
        195                 200                 205

Ala Ser Leu Asn Gly Thr Ser Met Ala Thr Pro His Val Ala Gly Ala
    210                 215                 220

Ala Ala Leu Val Lys Gln Lys Asn Pro Ser Trp Ser Asn Val Gln Ile
225                 230                 235                 240

Arg Asn His Leu Lys Asn Thr Ala Thr Ser Leu Gly Ser Thr Asn Leu
                245                 250                 255

Tyr Gly Ser Gly Leu Val Asn Ala Glu Ala Ala Thr Arg
            260                 265


<210> SEQ ID NO 2
<211> LENGTH: 269
<212> TYPE: PRT
<213> ORGANISM: Bacillus lentus

<400> SEQUENCE: 2

Ala Gln Ser Val Pro Trp Gly Ile Ser Arg Val Gln Ala Pro Ala Ala
1               5                   10                  15

His Asn Arg Gly Leu Thr Gly Ser Gly Val Lys Val Ala Val Leu Asp
            20                  25                  30

Thr Gly Ile Ser Thr His Pro Asp Leu Asn Ile Arg Gly Gly Ala Ser
        35                  40                  45

Phe Val Pro Gly Glu Pro Ser Thr Gln Asp Gly Asn Gly His Gly Thr
    50                  55                  60

His Val Ala Gly Thr Ile Ala Ala Leu Asn Asn Ser Ile Gly Val Leu
65                  70                  75                  80

Gly Val Ala Pro Ser Ala Glu Leu Tyr Ala Val Lys Val Leu Gly Ala
                85                  90                  95

Asp Gly Glu Gly Ala Ile Ser Ser Ile Ala Gln Gly Leu Glu Trp Ala
            100                 105                 110

Gly Asn Asn Gly Met His Val Ala Asn Leu Ser Leu Gly Ser Pro Ser
        115                 120                 125

Pro Ser Ala Thr Leu Glu Gln Ala Val Asn Ser Ala Thr Ser Arg Gly
    130                 135                 140
```

```
Val Leu Val Val Ala Ala Ser Gly Asn Ser Gly Ala Ser Ser Ile Ser
145                 150                 155                 160

Tyr Pro Ala Arg Tyr Ala Asn Ala Met Ala Val Gly Ala Thr Asp Gln
                165                 170                 175

Asn Asn Asn Arg Ala Ser Phe Ser Gln Tyr Gly Ala Gly Leu Asp Ile
            180                 185                 190

Val Ala Pro Gly Val Asn Val Gln Ser Thr Tyr Pro Gly Ser Thr Tyr
        195                 200                 205

Ala Ser Leu Asn Gly Thr Ser Met Ala Thr Pro His Val Ala Gly Ala
    210                 215                 220

Ala Ala Leu Val Lys Gln Lys Asn Pro Ser Trp Ser Asn Val Gln Ile
225                 230                 235                 240

Arg Asn His Leu Lys Asn Thr Ala Thr Ser Leu Gly Ser Thr Asn Leu
                245                 250                 255

Tyr Gly Ser Gly Leu Val Asn Ala Glu Ala Ala Thr Arg
            260                 265


<210> SEQ ID NO 3
<211> LENGTH: 269
<212> TYPE: PRT
<213> ORGANISM: Bacillus lentus

<400> SEQUENCE: 3

Ala Gln Ser Val Pro Trp Gly Ile Ser Arg Val Gln Ala Pro Ala Ala
1               5                   10                  15

His Asn Arg Gly Leu Thr Gly Ser Gly Val Lys Val Ala Val Leu Asp
            20                  25                  30

Thr Gly Ile Ser Thr His Pro Asp Leu Asn Ile Arg Gly Gly Ala Ser
        35                  40                  45

Phe Val Pro Gly Glu Pro Ser Thr Gln Asp Gly Asn Gly His Gly Thr
    50                  55                  60

His Val Ala Gly Thr Ile Ala Ala Leu Asn Asn Ser Ile Gly Val Leu
65                  70                  75                  80

Gly Val Ala Pro Ser Ala Glu Leu Tyr Ala Val Lys Val Leu Gly Ala
                85                  90                  95

Asp Gly Asp Gly Ala Ile Ser Ser Ile Ala Gln Gly Leu Glu Trp Ala
            100                 105                 110

Gly Asn Asn Gly Met His Val Ala Asn Leu Ser Leu Gly Ser Pro Ser
        115                 120                 125

Pro Ser Ala Thr Leu Glu Gln Ala Val Asn Ser Ala Thr Ser Arg Gly
    130                 135                 140

Val Leu Val Val Ala Ala Ser Gly Asn Ser Gly Ala Ser Ser Ile Ser
145                 150                 155                 160

Tyr Pro Ala Arg Tyr Ala Asn Ala Met Ala Val Gly Ala Thr Asp Gln
                165                 170                 175

Asn Asn Asn Arg Ala Ser Phe Ser Gln Tyr Gly Ala Gly Leu Asp Ile
            180                 185                 190

Val Ala Pro Gly Val Asn Val Gln Ser Thr Tyr Pro Gly Ser Thr Tyr
        195                 200                 205

Ala Ser Leu Asn Gly Thr Ser Met Ala Thr Pro His Val Ala Gly Ala
    210                 215                 220

Ala Ala Leu Val Lys Gln Lys Asn Pro Ser Trp Ser Asn Val Gln Ile
225                 230                 235                 240

Arg Asn His Leu Lys Asn Thr Ala Thr Ser Leu Gly Ser Thr Asn Leu
                245                 250                 255
```

-continued

```
Tyr Gly Ser Gly Leu Val Asn Ala Glu Ala Ala Thr Arg
            260                 265
```

The invention claimed is:

1. A predosed, essentially solid dishwashing detergent comprising a protease which comprises an amino acid sequence which is at least 90% identical to the amino acid sequence given in SEQ ID NO: 1 and which has the amino acid glutamic acid (E) or aspartic acid (D) at position 99 in the count according to SEQ ID NO:1, wherein any other differences between SEQ ID NO:1 and the amino acid sequence of the protease are conservative amino acid substitutions, and wherein the predosed, essentially solid dishwashing detergent comprises less than 50% by weight of a liquid fraction and has improved detergency against custard stains compared to a composition lacking a protease having an E or D at position 99 in the count according to SEQ ID NO: 1.

2. The dishwashing detergent according to claim 1, wherein it further comprises a hydrogen peroxide source and a bleach catalyst, wherein the bleach catalyst is selected from the group of bleach-boosting transition metal salts and transition metal complexes, and the hydrogen peroxide source is sodium percarbonate, sodium perboratetetrahydrate, sodium perboratemonohydrate, or a combination thereof.

3. The dishwashing detergent according to claim 1, wherein it comprises the protease in an amount of $1\times10^{-8}$-10% by weight, based on the total protein content of the protease.

4. The dishwashing detergent according to claim 1, wherein it further comprises a bleach activator.

5. The dishwashing detergent according to claim 1, wherein it is a machine dishwashing detergent.

6. The dishwashing detergent according to claim 1, wherein it is in the form of a flowable powder or shaped body.

7. The dishwashing detergent according to claim 1, wherein it comprises at least one further ingredient selected from the group consisting of builder, surfactant, anionic polymer, and combinations thereof, and/or wherein it comprises at least one further enzyme.

8. A method for removing stains on hard surfaces comprising one of the steps (a) bringing the hard surface into contact with a cleaning liquor which comprises a dishwashing detergent according to claim 1, or (b) bringing the hard surface into contact with a cleaning liquor which comprises a protease which comprises an amino acid sequence which is at least 90% identical to the amino acid sequence given in SEQ ID NO: 1 and which has the amino acid glutamic acid (E) or aspartic acid (D) at position 99 in the count according to SEQ ID NO: 1, wherein any other differences between SEQ ID NO:1 and the amino acid sequence of the protease are conservative amino acid substitutions, and wherein the cleaning liquor has improved detergency against custard stains compared to a composition lacking a protease having an E or D at position 99 in the count according to SEQ ID NO: 1.

9. The dishwashing detergent according to claim 2 wherein the bleach catalyst is selected from a metal complex of manganese with 1,4,7-trimethyl-1,4,7-triazacyclononane (Me-TACN) or 1,2,4,7-tetramethyl-1,4,7-triazacyclononane (Me/Me-TACN).

10. The dishwashing detergent according to claim 2 comprising the bleach catalyst in an amount of 0.0025-1% by weight.

11. The dishwashing detergent according to claim 2 comprising the hydrogen peroxide source in an amount of 2-30% by weight.

12. The dishwashing detergent according to claim 4 comprising the bleach activator in an amount of 0.1-10% by weight.

13. The dishwashing detergent according to claim 4 wherein the bleach activator is TAED.

14. The dishwashing detergent according to claim 1 wherein it is in the form of a tablet.

15. The dishwashing detergent according to claim 7 wherein the at least one further enzyme is selected from the group consisting of a protease, amylase, cellulase, pectin-cleaving enzyme, hemicellulase, mannanase, tannase, xylanase, xanthanase, β-glucosidase, carrageenase, perhydrolase, oxidase, oxidoreductase, a lipase, and combinations thereof.

16. The dishwashing detergent according to claim 7 wherein the at least one further enzyme is a combination selected from the group consisting of protease and amylase, protease and lipase, protease and cellulase, protease and mannanase, amylase and lipase, amylase and cellulase, amylase and mannanase, lipase and cellulase, lipase and mannanase, lipase and cellulase, protease and amylase and lipase, protease and amylase and cellulase, protease and amylase and mannanase, amylase and lipase and cellulase, amylase and lipase and mannanase, lipase, cellulase and mannanase, protease and amylase and lipase and cellulase, and protease and amylase and cellulase and mannanase.

17. The method according to claim 8 wherein the stain is a custard stain.

18. The method according to claim 8 wherein the hard surface is a dish.

19. The dishwashing detergent according to claim 1, comprising from 0.04 to 0.38% by weight of the protease which comprises an amino acid sequence which is at least 90% identical to the amino acid sequence given in SEQ ID NO: 1 and which has the amino acid glutamic acid (E) or aspartic acid (D) at position 99 in the count according to SEQ ID NO: 1, based on the total protein content of the protease.

20. The method according to claim 8, wherein the cleaning liquor comprises from 0.04 to 0.38% by weight of the protease which comprises an amino acid sequence which is at least 90% identical to the amino acid sequence given in SEQ ID NO: 1 and which has the amino acid glutamic acid (E) or aspartic acid (D) at position 99 in the count according to SEQ ID NO: 1, based on the total protein content of the protease.

21. A method for removing egg or custard stains on dish surfaces comprising one of the steps (a) bringing a dish surface having an egg or custard stain into contact with a cleaning liquor which comprises a dishwashing detergent according to claim 1, or (b) bringing a dish surface having an egg or custard stain into contact with a cleaning liquor which comprises a protease which comprises an amino acid sequence which is at least 90% identical to the amino acid sequence given in SEQ ID NO: 1 and which has the amino acid glutamic acid (E) or aspartic acid (D) at position 99 in the count according to SEQ ID NO: 1, wherein any other differences between SEQ ID NO:1 and the amino acid sequence of the protease are conservative amino acid substitutions, and wherein the cleaning liquor has improved detergency against egg or custard stains compared to a composition lacking a protease having an E or D at position 99 in the count according to SEQ ID NO: 1.

* * * * *